United States Patent [19]

Deis et al.

[11] 4,437,383

[45] Mar. 20, 1984

[54] MUZZLE ARC SUPPRESSOR FOR ELECTROMAGNETIC PROJECTILE LAUNCHER

[75] Inventors: Daniel W. Deis, Churchill Borough; George A. Kemeny, Wilkins Township, Allegheny County, both of Pa.

[73] Assignee: Westinghouse Electric Corp., Pittsburgh, Pa.

[21] Appl. No.: 309,861

[22] Filed: Oct. 8, 1981

[51] Int. Cl.[3] ..... F41F 1/00

[52] U.S. Cl. ..... 89/8; 124/3

[58] Field of Search ..... 89/8; 124/3; 310/10

[56] References Cited

U.S. PATENT DOCUMENTS 2,870,675 1/1959 Salisbury ..... 89/8

4,369,691 1/1983 Baehr, Jr. et al. ..... 89/8

OTHER PUBLICATIONS

"The Acceleration of Macroparticles and Hypervelocity Electromagnetic Accelerator," Barber (3/72) pp. 117–120, Australian National University, Canberra.

UCRL-52778, part 2, (7/79) Hawke page 4, "Devices for Launching Oilg Projectiles to 150 Km/s or More to Initiate Fusion", Part 2 Railgun Accelerators.

*Primary Examiner*—Sal Cangialosi

*Attorney, Agent, or Firm*—F. J. Baehr, Jr.

[57] ABSTRACT

An electromagnetic projectile launcher having a pair of conductive rails with a breech and a muzzle end and an impedance electrically connected across the conductive rails adjacent the muzzle end of the conductive rails, and a second impedance in the muzzle end of the rails whereby arcs which commutate the current to the first impedance are confined within the muzzle to substantially suppress any external arc as the projectile exits from the launcher.

17 Claims, 3 Drawing Figures

MUZZLE ARC SUPPRESSOR FOR ELECTROMAGNETIC PROJECTILE LAUNCHER

CROSS-REFERENCE TO RELATED APPLICATIONS

This application is closely related to an application filed the same day and identified by Assignee No. 50008.

BACKGROUND OF THE INVENTION

This invention relates to electromagnetic projectile launchers, and more particularly to a muzzle arc suppressor for such devices.

In electromagnetic projectile launchers, a sliding electrical conductor, an armature, or alternatively, an arc between the rails with an insulating sabot, accelerates a projectile to muzzle velocity within the barrel length. This acceleration is produced by the interaction of the armature current and the magnetic field produced by the same current flowing in the conductive rails of the barrel. When the armature leaves the muzzle, the electrical circuit is opened, causing an arc to form. This arc will produce an intense flash which is easily detected from a great distance and will cause erosion and thermal damage to the rails at the muzzle. These occurrences are particularly undesirable if the electromagnetic launcher is used for military applications.

SUMMARY OF THE INVENTION

In general, an electromagnetic projectile launcher, when made in accordance with this invention, comprises a pair of generally parallel conductors having a breech and a muzzle end, an armature slidably disposed between the conductors, a source of high current connected to the conductors, a first impedance disposed across the conductors adjacent the muzzle end thereof, and a second impedance disposed in at least one of said conductors on the muzzle side of where the first impedance is connected across the conductors, whereby current is rapidly commutated to the first impedance to suppress muzzle arcing.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
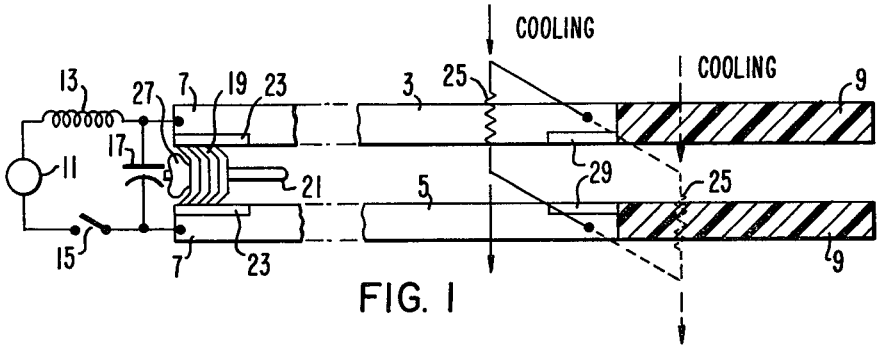
FIG. 1 is a schematic diagram of an electromagnetic projectile launcher made in accordance with this invention.

Referring now to the drawings in detail and in particular to FIG. 1, there is shown an electromagnetic projectile launching system which comprises a pair of parallel conductive rails 3 and 5, respectively, disposed in a barrel (not shown), having a breech and muzzle end 7 and 9, respectively, a homopolar generator 11 or other means for supplying high current, an induction coil 13 and a make switch 15 connected in series to the breech ends 7 of the conductors 3 and 5. A circuit breaker 17 is electrically connected across the breech end of the conductive rails 3 and 5.

An armature 19 or other means such as an arc and bore sealing sabot is utilized for conducting current between the conductors 3 and 5 and for accelerating a projectile 21 as it moves from the breech 7 to the muzzle 9 end of the coductive rails. On the breech end of the conductive rails are resistive inserts 23 or other means which prevent premature launching and excessive heating of the armature before the circuit breaker 17 is opened to commence firing.

An impedance 25 is electrically connected across the conductive rails adjacent the muzzle end 9. The impedance 25 preferably has a low inductance and may be made of tungsten or other material in which the resistance increases as the temperature increases to assist in rapidly commutating the current to the impedance 25 and thereafter, due to increase in resistance, more rapidly dissipating the energy to reduce heating of the conducting rails. The impedance 25 may be symmetrically disposed on both sides of the conductive rails as shown in FIG. 1; and as shown in FIG. 3, it may also be disposed to substantially link the flux in the armature and rails, to further assist in rapidly commutating current to the impedance 25.

Figure 2:
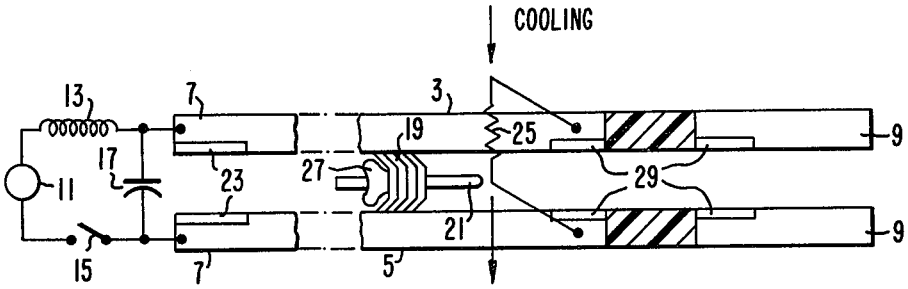

As shown in FIG. 2, an arc horn structure 27 may be disposed on the trailing end of the armature 19 to prevent the arcs drawn from the conductors as the armature 19 separates therefrom and enters the muzzle from coalescing into a single arc between the conductors.

Figure 3:
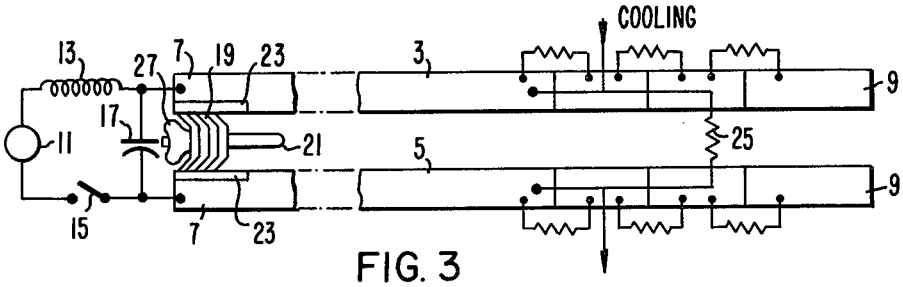
FIGS. 2 and 3 are alternative embodiments of this invention.

The muzzle end 9 of the rails may be formed of an insulating material as shown in FIG. 1; or the muzzle end 9 may be insulated from the rails as shown in FIG. 2; or as shown in FIG. 3, may be made of a resistive material, preferably the resistivity increasing in the direction of the muzzle. By prevention of arcing near the muzzle in such a configuration as FIG. 1, there will be no arc wear near the muzzle and the bore guiding surfaces will not be deteriorated resulting in maintaining accuracy for many shots.

These arrangements all add a second impedance in series with the driving current either utilizing arcs or a resistive material or a combination thereof to obtain a voltage drop, which rapidly commutates the current to the first-mentioned impedance 25 connected across the rails adjacent the muzzle; and since the muzzle end can be long, the arcs are confined within the barrel and not generally externally visible.

As shown in FIGS. 1 and 2, arc-resistive inserts which may also introduce additional electrical impedance are preferably disposed on the rails at the general locations shown and the arc terminations will remain substantially stationary at these locations but arc damage or wear can be reduced to acceptable levels because the duration of the arcing and/or the current levels at the commencement of arcing will be reduced by the utilization of this invention. In FIG. 3, generally all of the muzzle segments are conductors so that the current is commutated to the impedance 25 before the armature 19 or arc and sabot reach the muzzle so that the muzzle arc is suppressed or eliminated.

Another alternative configuration for eliminating or reducing muzzle arcing involves placing the impedance 25 a deliberately greater distance from the muzzle end of normally conducting rails. In that case, due to the longer rail length beyond the attachment locations of the impedance 25, the voltage produced by rail impedance beyond the attachment locations together with the voltage drop across the rails due to the projectile driving current combine and can result in both a high enough voltage and for a long enough period of time to substantially or entirely commutate the current into the impedance 25. This commutation can be expedited by having a linkage of fluxes between the as yet uncommutated driving current in the rails and the already commutated current in the impedance 25, and thus a favorable flux disposition.

The muzzle arc suppressors hereinbefore described advantageously set forth several devices, wherein commutation of current into the muzzle resistor is achieved without producing any arc at all, or at least without producing an externally visible arc. This is achieved by introducing resistive and/or insulating sections in the barrel adjacent the muzzle end thereof.

What is claimed is:

1. An electromagnetic projectile launcher comprising:

a pair of generally parallel conductors having a breech and a muzzle end;

means for conducting current between said conductors and for accelerating said projectile;

a source of high current connected to said conductors;

a first impedance disposed across said conductors adjacent the muzzle end thereof;

a second impedance disposed in at least one of said conductors on the muzzle side of where said first impedance is connected across said conductors;

whereby current is commutated to said first impedance to suppress muzzle arcing.

2. An electromagnetic projectile launcher as set forth in claim 1, wherein the first impedance is substantially all resistance to facilitate rapid commutation of current thereto.

3. An electromagnetic projectile launcher as set forth in claim 1, wherein the first impedance is so disposed to substantially link its flux with the rails and the means for conducting current between the conductors for accelerating the projectile to facilitate rapid commutation of current to the first impedance.

4. An electromagnetic projectile launcher as set forth in claim 1, wherein the first impedance is made of a material with a characteristic that the resistance increases with temperature to facilitate rapid commutation of current to the first impedance and reduce heating of the conductors once current is commutated to the first impedance.

5. An electromagnetic projectile launcher as set forth in claim 1, wherein the second impedance is followed by an insulated muzzle portion.

6. An electromagnetic projectile launcher as set forth in claim 5, wherein the insulated muzzle portion includes arc-resistant material.

7. An electromagnetic projectile launcher as set forth in claim 5, wherein the insulated muzzle portion directs the projectile.

8. An electromagnetic projectile launcher as set forth in claim 1, wherein the second impedance is a high-resistive portion in at least one of the conductors.

9. An electromagnetic projectile launcher as set forth in claim 1, wherein the first impedance is disposed on opposite sides of the conductors.

10. A projectile launcher as set forth in claim 1 and further comprising cooling means disposed in said first impedance.

11. An electromagnetic projectile launcher comprising a pair of generally parallel conductors having a breech and a muzzle end;

means for conducting current between said conductors and for accelerating said projectile;

a source of high current connected to said conductors;

a first impedance disposed across said conductors adjacent the muzzle end thereof;

a muzzle portion electrically insulated from the conductors;

the length of the muzzle portion being such that the length of the arc which extends from the conductors to the means for conducting current and accelerating the projectile is sufficient to provide sufficient voltage for a sufficient period of time to commutate the current to the impedance disposed across the conductors and thereby extinguish the arc.

12. A projectile launcher as set forth in claim 11, wherein the means for conducting current between the conductors and for accelerating the projectile is an armature slidably disposed between the conductors.

13. An electromagnetic projectile launcher as set forth in claim 12, wherein the armature has arc horns and insulation on the trailing end and the arc horns and insulation prevent arcs drawn from the conductors as the armature separates therefrom and enters the muzzle from coalescing into a single arc between the conductors.

14. An electromagnetic projectile launcher comprising a pair of generally parallel conductors having a breech and a muzzle end;

means for conducting current between said conductors and for accelerating said projectile;

a source of high current connected to said conductors;

an impedance attached across said conductors a sufficient distance from the muzzle end thereof;

the length of the muzzle portion beyond said attachment of the impedance being such that the voltage drop due to the impedance of the conductors beyond the attachment location combined with the voltage drop produced by the means for conducting current between said conductors yields sufficient commutating voltage for a sufficient time period so that muzzle arcing is suppressed.

15. An electromagnetic projectile launcher as set forth in claim 14 wherein the impedance attached across said conductors is so located that the current still being conducted by the conductors and accelerating the projectile flows in close physical proximity and in corresponding direction to the current already commutated into the impedance so as to expedite commutation of the current into the impedance.

16. An electromagnetic projectile launcher as set forth in claim 15 wherein the more expeditious commutation produced by the physical proximity of uncommutated and commutated currents results in a shorter barrel portion between the muzzle and attachment of the impedance thereby attaining a shorter overall barrel length for obtaining the desired velocity without substantial muzzle arcing.

17. An electromagnetic projectile launcher as set forth in claim 14 wherein the conductors beyond where the first impedance is attached across said conductors are made of resistive material.

* * * * *